United States Patent [19]

Earl et al.

[11] 4,251,079

[45] Feb. 17, 1981

[54] PELLET FOR AN AIR, GAS OR SPRING GUN

[76] Inventors: Hugh E. Earl, 63 Hendon Way, London, N.W. 2; Michael Robbins, 1 Redwood Mount, Beech Rd., Reigate, Surrey, both of England

[21] Appl. No.: 938,047

[22] Filed: Aug. 30, 1978

[30] Foreign Application Priority Data

Jul. 3, 1978 [GB] United Kingdom ..... 28654/78

[51] Int. Cl.[3] ..... F42B 11/02

[52] U.S. Cl. ..... 273/428; 102/92.1

[58] Field of Search ..... 273/106 R, 106 E, 428, 273/92.7, 92.1; 102/92.1, 92.2, 92.3, 92.4

[56] References Cited

U.S. PATENT DOCUMENTS

| | | | |
|---|---|---|---|
| 355,653 | 1/1887 | Loyd | 102/92.4 |
| 421,932 | 2/1890 | Heisler | 102/92.4 |
| 637,312 | 11/1899 | Whittier | 273/106 R |
| 4,005,660 | 2/1977 | Pichard | 273/106 E X |

FOREIGN PATENT DOCUMENTS 1524858 2/1972 United Kingdom .

*Primary Examiner*—George J. Marlo
*Attorney, Agent, or Firm*—Morgan, Finnegan, Pine, Foley & Lee

[57] ABSTRACT

A pellet for an air gun or the like is provided having a head portion made of metal or metal containing plastics material and a shank extending rearwardly of the head portion, and a skirt portion secured to the head portion by the shank, said skirt portion having at least two sections which are larger in diameter than the head portion and being made of substantially elastic plastics material, for slidably engaging a gun barrel bore surface. The head portion provides weight for the skirt portion during flight. Preferably the skirt portion is made from plastics material with a low coefficient of friction and sufficient elasticity to regain its shape after deformation, such as P.T.F.E.

13 Claims, 3 Drawing Figures

FIG.1.
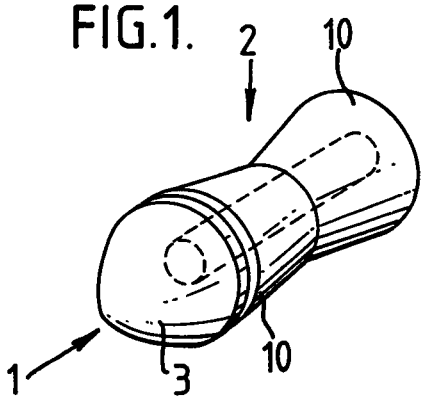
FIG.2.
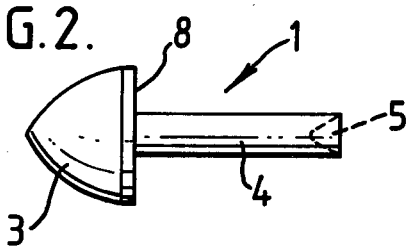
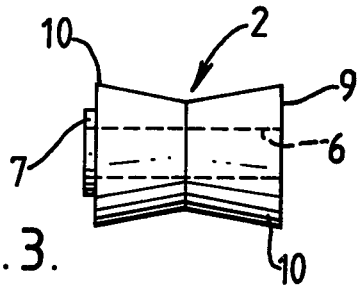
FIG.3.

PELLET FOR AN AIR, GAS OR SPRING GUN

FIELD OF THE INVENTION

This invention relates to a pellet for an air, gas or spring gun.

BACKGROUND OF THE INVENTION AND PRIOR ART

Conventional pellets for air, gas and spring guns are made of lead or a lead alloy which is soft enough not to score or damage the bore surface of the gun barrel during passage therealong. Unfortunately such conventional pellets, because they are made of such soft metal, are easily damaged and deformed out of shape prior to use, to such an extent as to render them unfit for use or seriously to impair their accuracy in use. Indeed lead pellets for match shooting are required to be individually packaged to minimise damage.

Furthermore conventional lead pellets have the additional disadvantage of a high coefficient of friction which can result, in use, in high energy losses by friction with the gun barrel bore surface during passage therealong. Attempts have been made to reduce these frictional losses by coating the pellet with a lubricant, but this lubricant coating is easily damaged and can cause fouling of the gun bore with subsequent loss of accuracy.

Other attempts have been made to solve these problems by the provision of pellets made wholly of plastics but these plastics pellets have only a short range and poor penetrative power due to lack of weight, stability and hardness. Alternative proposals have been felt based metal pellets which have had poor sealing with the gun bore surface and a consequent drop in muzzle velocity, and steel darts with a fibrous base, which can seriously damage the gun bore surface.

Additionally such conventional pellets when made to fit standard Imperial size bores such as 0.177 inches and 0.22 inches will not fit corresponding equivalent Metric size bores such as 4.5 millimeters and 5.5 millimeters. This is because a 0.177 inch bore pellet is slightly over size for the equivalent 4.5 millimeter bore which is not exactly the same size as the 0.177 inch bore. This means that Metric and Imperial size pellets are not interchangeable and hence Imperial and Metric size bores require corresponding size pellets for accuracy.

OBJECT OF THE INVENTION

An object of the invention is to provide a generally improved pellet which is not easily deformed during handling.

Another object of the invention is to provide a pellet which has a low coefficient of friction and hence greater efficiency in use.

A further object of this invention is to provide a pellet which does not damage the gun bore surface and which can be used in equivalent Imperial and Metric size bores.

SUMMARY OF THE INVENTION

Accordingly the present invention provides a pellet for an air, gas or spring gun, having a head portion made of metal or metal containing plastics material and a skirt portion, larger in diameter than the head portion and made of substantially elastic plastics material, for slidably engaging a gun barrel bore surface, the head portion providing weight for the skirt portion during flight of the pellet.

Preferably the skirt portion is made from plastics material with a low coefficient of friction and sufficient elasticity to regain its shape after deformation, such as poly-tetrafluoro-ethylene (P.T.F.E.), Teflon (Trade Mark) or Nylon (Trade Mark). The skirt portion may be axially elongated in form and preferably has two axially spaced maximum diameter portions for peripheral engagement with the gun bore surface.

The head portion may be made of brass or any other convenient metal or alloy such as steel or lead. Preferably the head portion is mushroom shaped with an elongated reduced diameter shank over which the skirt portion is fitted or coated. Conveniently the head portion shank end is upturned behind the skirt portion base to retain the skirt portion attached to the head portion.

However according to one aspect of the invention the pellet may be provided in the form of a head portion made from metal or metal containing plastics material and a separate skirt portion, larger in diameter than the head portion and made of substantially elastic plastics material, for subsequent fixed assembly together.

Other objects and features of the invention will become apparent from the following detailed description of preferred but non-limitative embodiments and the accompanying drawings made a part hereof and to which reference is made.

BRIEF DESCRIPTION OF THE DRAWINGS

FIG. 1 is a perspective view to an enlarged scale of an assembled pellet according to one embodiment of the present invention.

FIG. 2 is a side view of a head portion of the pellet of FIG. 1, and

FIG. 3 is a side view of a skirt portion of the pellet of FIG. 1.

As shown in the accompanying drawings a pellet according to one embodiment of the invention for an air, gas or spring gun has a head portion 1 and a skirt portion 2. The head portion 1 is made of any convenient metal or metal containing plastics material such as steel, lead and preferably is made of brass. The skirt portion 2 is cylindrical in cross section and larger in outer diameter than the head portion 1 which also is cylindrical in cross section. The skirt portion 2 is made of substantially elastic plastics material with a low coefficient of friction and sufficient elasticity to regain its shape after deformation, such as poly-tetra-fluoro-ethylene (P.T.F.E.), Teflon (Trade Mark) or Nylon (Trade Mark), preferably a non-metallic plastics material to avoid wear of the gun barrel surface. The head portion 1 provides weight, and thus stability and accuracy, for the skirt portion 2 during flight of the pellet.

As can be seen from FIG. 2 the head portion 1 is mushroom shaped with a domed head 3 and a reduced diameter shank 4 extending axially from the head 3. The end of the shank opposite to the head 3 is provided with a blind bore 5. As shown in FIG. 3 the skirt portion 2 is axially elongated and generally cylindrical in shape, with an open ended axial bore 6 therethrough dimensioned to fit over the shank 4. With the skirt portion bore 6 fitted on the shank 4 with an end face 7 of the skirt portion 2 abutting an end face 8 of the head 3, the skirt portion 2 is retained fixedly on the head portion 1 in any convenient manner such as by crimping the skirt portion to the shank 4, by upsetting the blind bore end 5 of the shank behind the base 9 of the skirt portion, or by providing a tight fit between the shank and skirt bore.

Two axially spaced maximum diameter portions 10 are provided on the skirt portion 2 for peripheral engagement with the gun bore surface. In this way the pellet only contacts the bore surface at two places which further reduces the friction between the pellet and the bore surface. The head 3 which is smaller in diameter than the portions 10 of the skirt portion thus does not contact the gun bore surface during passage of the pellet therealong. Moreover as the pellet contacts the bore surface at two axially spaced apart regions over its length, in the gun barrel, yawing is prevented and accuracy thereby improved.

Such a pellet can be made in any convenient manner. For example the brass head portion 1 can be ground from a blank to the correct weight and dimensions or can be stamped out or cast or moulded to shape. The skirt portion 2 can also be ground from a possibly extruded blank, stamped out, cast or moulded or even formed directly on to the shank 4 of the hear portion 1 such as by casting, moulding or coating thereon.

As an alternative to the construction of the illustrated embodiment, the head portion 1 may be made without the shank 4 and the skirt portion 2 without the bore 6. In this construction the skirt portion is attached to the head portion by crimping a rim part of the head portion over a reduced diameter grooved or flanged region on the skirt portion ensuring that the head portion is smaller in diameter than the portions of the skirt portion which contact the gun bore surface. Indeed more or less than two such maximum diameter portions may be provided on the skirt portion for contact with the bore surface. For high powered guns where friction losses are less important the skirt portion may contact the bore surface over most of the length of the skirt portion. However, the waisted form of skirt portion of the illustrated embodiment is preferred. Moreover, the head portion may have a flat disc shape in which case the domed head 3 is omitted and only the disc portion carrying the face 8 is retained.

Alternatively for target match shooting the skirt portion 2 may be made with a bore 6 having a blind leading end at end face 7. In this case the head portion may again have a flat disc shape without the domed head 3 and be entered into the bore 6 by pressing the free end of the shank 4 through the blind bore end face 7 with the flat disc end of the head portion being recessed if desired in the end face 7. In a modification of the last alternative the part of the shank portion at the end face 7 having the blind leading end of the bore 6 provides the head portion itself in co-operation with a metal shank 4 entered in the bore from the open bore end. In the latter case the shank 4 may be suitably shaped to provide the desired balance and accuracy for the resulting pellet which thus does not have a metal leading end. The provision of a plastics material leading end for this form of pellet, which may be suitably shaped, makes it particularly suitable for target shooting as it is less likely to damage the target holder than is a metal ended pellet. The shank portion and skirt portion thus co-operate to provide for the pellet a head portion made of metal containing plastics material.

The skirt portion and head portion of the pellet must stay together in flight so that the head portion provides stabilising weight for the skirt portion and to this end the skirt portion and head portion may be fixedly secured to one another. However, the head portion and skirt portion may be sold separated from one another for subsequent assembly together and the invention contemplates this aspect also. Indeed one size of head portion can be used for different bore sizes by combining it with the correct bore size skirt portion.

A pellet of the invention is suitable for use in air, gas or spring guns with a rifled or smooth bore, such as those having a rechargeable reservoir for air, for example, a pneumatic gun, or for gas, for example, a $CO_2$ gun. The pellet is also suitable for a spring gun in which the motive force is provided by the release of energy stored in a spring. Moreover, the head portion of the pellet may be provided with an anaesthetising charge and an apertured hypodermic needle tip for the discharge of this charge on impact into an animal whose skin has been pierced by the hypodermic head portion on impact.

Because of the elastic nature of the skirt portion a pellet of the invention is particularly suitable for use in a repeating action gun. Previous forms of pellet deformed during charging and thus jammed the repeating action. Pellets of the invention do not so deform. Because of this lack of permanent deformation pellets of the invention are easy to handle and do not require special packaging. Moreover, the resilient elastic nature of the skirt portion allows a pellet of the invention to be used interchangeably in equivalent Imperial and Metric Bore sizes without jamming or loss of muzzle velocity if an Imperial bore size pellet (0.177 inch) is used in the equivalent Metric size bore (4.5 millimeters).

We claim:

1. A pellet for an air, gas or spring gun having a barrel bore through which said pellet travels when the gun is activated, said pellet comprising:

a head portion adapted to provide weight for the pellet for stability during flight and penetration when striking a target; and a skirt portion made of a different overall composition from said head portion, said skirt portion adapted to be securely attached to said head portion, said skirt portion being made of a substantially elastic plastic material which is essentially free of any metal filler and being proportioned with at least two portions which are larger in diameter than said head portion at its largest diameter, such that said pellet slidably engages the gun barrel bore essentially only by said large-diameter portions of said skirt portion which are deformed slightly during slidable travel of the pellet through said barrel bore, yet said skirt portion returns substantially to its original configuration once expelled from the gun barrel.

2. A pellet according to claim 1, wherein said head portion is made of metal.

3. A pellet according to claim 2, in which the skirt portion is axially elongated in form, with two axially spaced maximum diameter portions for peripheral engagement with a gun bore surface.

4. A pellet according to claim 2, in which the head portion is made of brass.

5. A pellet according to claim 1, wherein said head portion is made of a metal-containing plastic material.

6. A pellet according to claim 1, in which the skirt portion is made from plastics material with a low coefficient of friction.

7. A pellet according to claim 6, in which the skirt portion is made from poly-tetra-fluoro-ethylene (P.T.F.E.), Teflon (Trade Mark) or Nylon (Trade mark).

8. A pellet according to any one of claims 2 or 4, in which the head portion is mushroom shaped with an elongated reduced diameter shank over which the skirt portion is fitted or coated.

9. A pellet according to claim 8, wherein the shank end is upturned behind the skirt portion base to retain the skirt portion attached to the head portion.

10. A pellet according to claim 8, wherein the skirt portion is a tight fit on the shank to retain the skirt portion attached to the head portion.

11. A pellet according to any one of claims 1, 6 or 3, in which the head portion has a flat disc shape with an elongated shank over which the skirt portion is fitted or coated.

12. A pellet according to claim 11, wherein the shank end is upturned behind the skirt portion base to retain the skirt portion attached to the head portion.

13. A pellet according to claim 11, wherein the skirt portion is a tight fit on the shank to retain the skirt portion attached to the head portion.

* * * * *